United States Patent [19]

Ishihara

[11] 4,167,369

[45] Sep. 11, 1979

[54] IMPELLER BLADING OF A CENTRIFUGAL COMPRESSOR

[75] Inventor: Takeshi Ishihara, Oyama, Japan

[73] Assignee: Kabushiki Kaisha Komatsu Seisakusho, Tokyo, Japan

[21] Appl. No.: 840,042

[22] Filed: Oct. 6, 1977

[30] Foreign Application Priority Data

Apr. 4, 1977 [JP] Japan ..... 52-37643

[51] Int. Cl.[2] ..... F04D 17/10

[52] U.S. Cl. ..... 416/185; 416/183; 416/188

[58] Field of Search ..... 416/183, 185, 188, 223 B; 415/213 R, 219 C

[56] References Cited

U.S. PATENT DOCUMENTS

| | | | |
|---|---|---|---|
| 2,648,493 | 8/1953 | Stalker | 416/183 X |
| 2,965,287 | 12/1960 | Schug | 416/183 X |
| 3,481,531 | 12/1969 | MacArthur et al. | 416/183 X |
| 3,984,193 | 10/1976 | Yu | 416/185 X |

FOREIGN PATENT DOCUMENTS

| | | | |
|---|---|---|---|
| 959692 | 3/1957 | Fed. Rep. of Germany | 416/185 |
| 2021260 | 11/1971 | Fed. Rep. of Germany | 416/185 |
| 1325267 | 3/1963 | France | 416/183 |
| 492190 | 3/1954 | Italy | 416/183 |
| 594537 | 11/1947 | United Kingdom | 416/183 |

*Primary Examiner*—Everette A. Powell, Jr.
*Attorney, Agent, or Firm*—Armstrong, Nikaido, Marmelstein & Kubovcik

[57] ABSTRACT

Each blade on an impeller disc comprises an impeller portion extending substantially radially of the disc and a centrally located inducer portion on the front side of the impeller portion, the inducer portion being angled from the impeller portion in the direction of impeller rotation. The impeller portion itself is mostly inclined in the direction of impeller rotation, with the angle between the impeller portion and the front face of the disc being about 90 degrees at its inner end and gradually decreasing toward its outer end, where the angle is in the range of from about 50 to 70 degrees. Preferably, these blades are arranged alternately with auxiliary blades which are essentially identical with the impeller portions of the first recited blades.

5 Claims, 15 Drawing Figures

IMPELLER BLADING OF A CENTRIFUGAL COMPRESSOR

BACKGROUND OF THE INVENTION

1. Field of the Invention

This invention relates to compressors, to centrifugal or radial-flow compressors, and to the impeller of such a compressor. Still more specifically, the invention is directed to improvements in the impeller blading of a centrifugal compressor employed for superchargers or gas turbines, among other applications.

2. Description of the Prior Art

According to a well known example of impeller used in a centrifugal compressor for the above applications, each blade is so shaped and arranged on the impeller disc (as shown in FIGS. 1 through 4 of the accompanying drawings) that, theoretically, the fluid pressure or head developed at the impeller outlet is substantially constant in a direction parallel to the impeller axis.

In the centrifugal compressor of the type under consideration, however, pressure loss due to various causes is higher on the front side of the impeller outlet than on its rear side. As a consequence, the actual pressure developed by the impeller is considerably lessened on the front side of its outlet, with the resultant decrease in the total work done by the compressor.

SUMMARY OF THE INVENTION

It is an object of this invention to provide an improved impeller for a centrifugal compresor, so made that the performance of the compressor can be markedly improved.

Another object of the invention is to provide such an impeller which is easy and inexpensive to manufacture and which can be readily installed in a known compressor without alteration of its other parts.

In accordance with this invention, briefly stated, there is provided an impeller comprising a plurality of blades fixedly mounted on the front face of a disc including a hub portion. Each blade integrally comprises an impeller portion extending substantially radially of the disc, and a centrally located inducer portion on the front side of the impeller portion. The impeller portion of each blade is mostly inclined forwardly with respect to the direction of rotation of the impeller, with the angle between the impeller portion and the front face of the disc being about 90 degrees at the inner end of the impeller portion and gradually decreasing outwardly, to a range of from about 50 to about 70 degrees at the outer end of the impeller portion. The inducer portion of each blade is further inclined forwardly from the impeller portion with respect to the direction of impeller rotation.

The improved impeller of the invention being constructed as in the foregoing, Euler work of the impeller can be made higher on the front side of the impeller outlet than on its rear side. The pressure loss distribution of the compressor is such that the actual pressure at the impeller outlet can be made constant in the direction parallel to the impeller axis. It is possible in this manner to improve the compression ratio and efficiency of the compressor and to increase the total work done thereby.

The above and other objects, features and advantages of this invention and the manner of attaining them will become more apparent, and the invention itself will best be understood, from the following description and appended claims taken together with the accompanying drawings.

DETAILED DESCRIPTION

Figure 1:
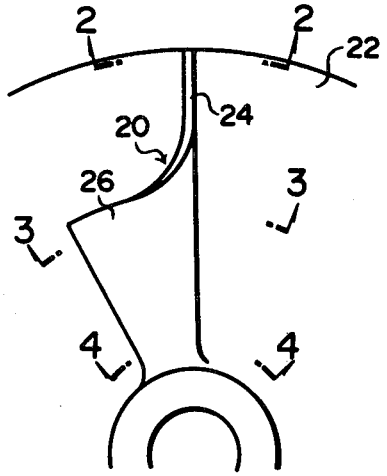
FIG. 1 PRIOR ART
FIG. 1 is a partial, schematic front view of a prior art impeller for a centrifugal compressor, the view being explanatory of the construction of each blade of the prior art impeller.

Prior to the description of a preferred embodiment of this invention, it is considered essential that the prior art impeller blading having particular pertinence to the invention be shown and described in some more detail, the better to make clear the features and advantages of the invention. With reference to FIG. 1, there is shown one of such conventional blades 20 arranged radially on an impeller disc 22. The blade 20 comprises an impeller portion 24 and an inducer portion 26.

Figure 3:
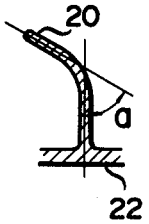
FIG. 3 PRIOR ART
FIG. 3 is a similar view of the prior art impeller blade taken along the line 3—3 in FIG. 1.
Figure 2:
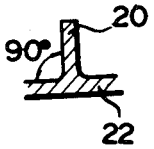
FIG. 2 PRIOR ART
FIG. 2 is a sectional view of the prior art impeller blade taken along the line 2—2 in FIG. 1.
Figure 4:
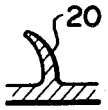
FIG. 4 PRIOR ART
FIG. 4 is also a similar view of the prior art impeller blade taken along the line 4—4 in FIG. 1.

As will be seen from the sectional views of the blade 20 given in FIGS. 2, 3 and 4, its impeller portion 24 is disposed normal to the face of the impeller disc 22 substantially throughout its length in the radial direction of the disc. The inducer portion 26 is bent forwardly with respect to the direction of rotation of the impeller, with a comparatively great "transition angle" a between the inducer portion and the impeller portion.

Figure 5:
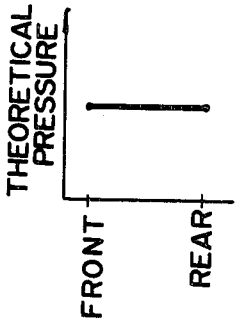
FIG. 5 PRIOR ART
FIG. 5 is a graphical representation of the theoretical fluid pressure distribution at the outlet of the prior art impeller and in the direction parallel to the impeller axis.
Figure 6:
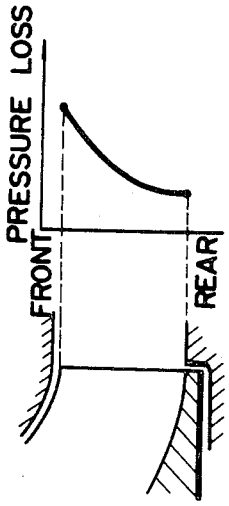
FIG. 6 PRIOR ART
FIG. 6 is a graphical representation of the pressure loss distribution at the outlet of the prior art impeller and in the direction parallel to the impeller axis.

This prior art configuration of the impeller blades results, theoretically, in constant fluid pressure at the impeller outlet in the direction parallel to the impeller axis, as graphically represented in FIG. 5. The centrifugal compressor of this type, however, is subject to various pressure losses such as blade loading loss, frictional loss, and clearance loss. The overall pressure loss due to such causes is higher on the front side of the impeller outlet than on its rear side, as will be apparent from the graph of FIG. 6.

Figure 7:
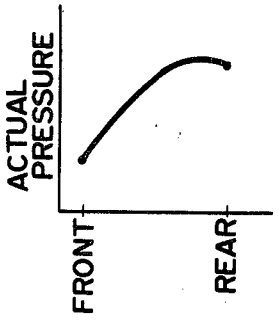
FIG. 7 PRIOR ART
FIG. 7 is a graphical representation of the actual fluid pressure distribution at the outlet of the prior art impeller and in the direction parallel to the impeller axis.

FIG. 7 graphically represents the distribution of the actual fluid pressure in a plane tangent to the impeller outlet. The overall work done by the compressor is appreciably decreased by the smaller fluid pressure on the front side of the impeller outlet. This defect of the prior art is thoroughly overcome by the present invention as described hereinbelow in connection with FIGS. 8 through 15.

Figure 8:
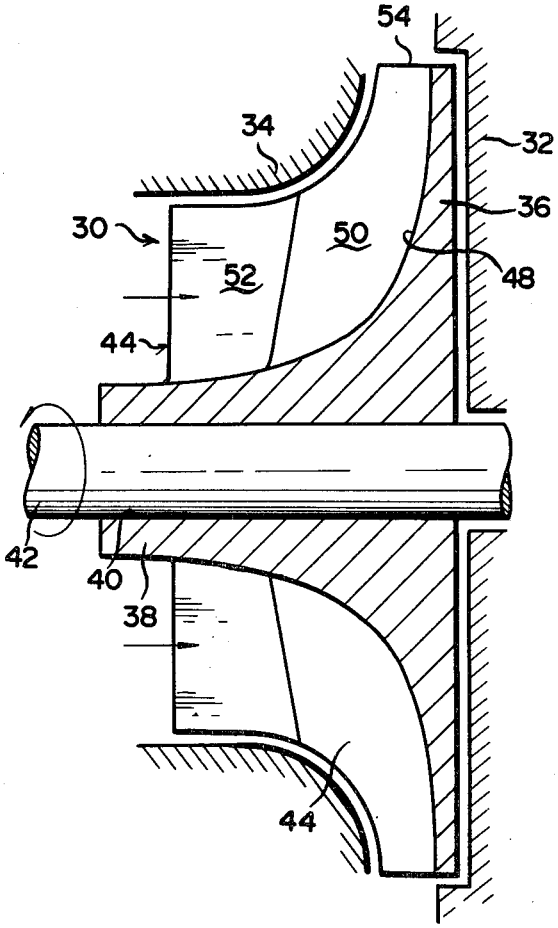
FIG. 8 is an axial sectional view of the improved impeller constructed in accordance with the principles of this invention, with the impeller being shown mounted in a compressor casing which is shown fragmentarily.

With reference to FIG. 8, the improved impeller for a centrifugal compressor in accordance with the invention is generally designated 30 and is shown mounted within a compressor casing 32. This compressor casing has a shroud 34 covering the front of the impeller 30 and defining an inlet through which fluid, usually air, is drawn into the compressor.

The impeller 30 includes a disc 36 which is formed integral with a hub 38 projecting forwardly from the impeller disc and oriented coaxial therewith. The hub 38 defines an axial bore 40 for closely receiving a drive shaft 42 connected to a motor or other drive means, not shown, for imparting rotation to the impeller 30 in a predetermined direction with respect to the casing 32.

Figure 9:
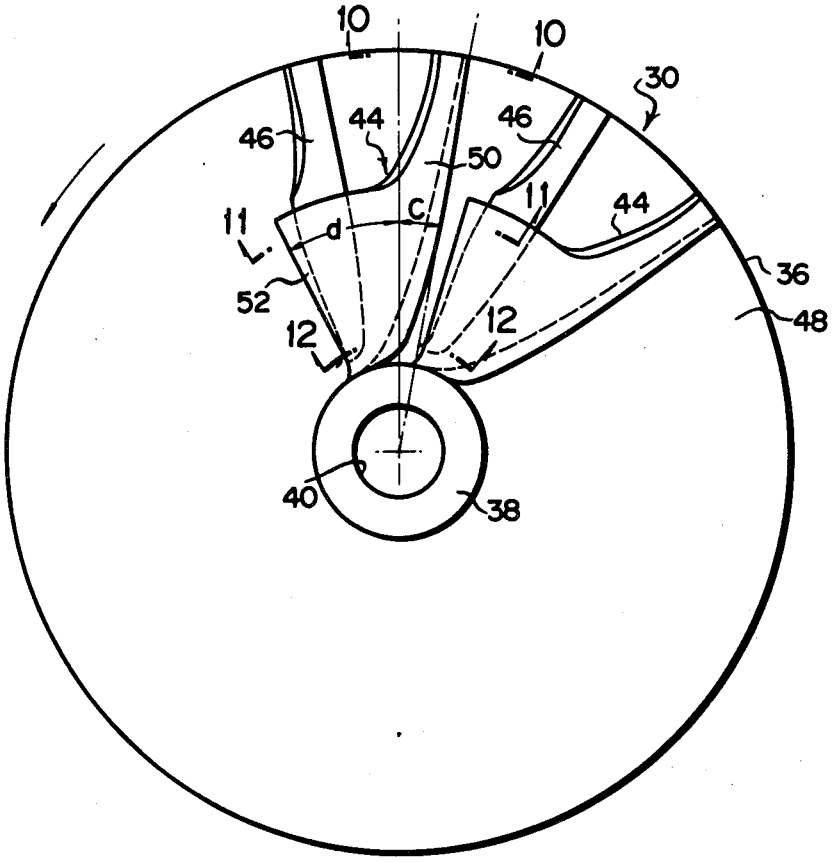
FIG. 9 is a schemtic front view of the improved impeller of FIG. 8.

As will be seen from both FIGS. 8 and 9, a plurality of main blades 44 and a plurality of auxiliary blades 46 are fixedly mounted alternately and at constant angular spacings on the front face 48 of the impeller disc 36 inclusive of the hub 38. It will be understood from FIG. 8 that no clear boundary exists between disc 36 and hub 38, so that the main and the auxiliary blades 44 and 46 are herein described as being mounted on the front face of the disc even though, strictly speaking, the blades are partly secured to the circumference of the hub. The illustrated shape of the impeller disc 36 together with the hub 38 has been known.

Each main blade 44 integrally comprises an impeller portion 50 extending substantially radially of the disc and a centrally located inducer portion 52 on the front side of the impeller portion. The main blade 44 is mostly inclined forwardly with respect to the direction of rotation of the impeller 30.

Figure 10:
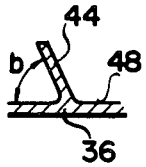
FIG. 10 is a sectional view of one of the main blades of the improved impeller taken along the line 10—10 in FIG. 9.
Figure 11:
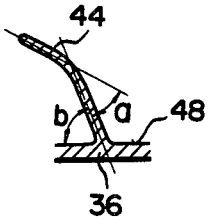
FIG. 11 is a similar view of the main blade taken along the line 11—11 in FIG. 9.
Figure 12:
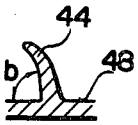
FIG. 12 is also a similar view of the main blade taken along the line 12—12 in FIG. 9.

With reference directed also to the sectional views of FIGS. 10 through 12, the angle b between the impeller portion 50 of each main blade 44 and the front face 48 of the impeller disc 36 is about 90 degrees, usually slightly less than 90 degrees, at the inner end of the impeller portion and gradually decreases toward its outer end at the perimeter of the impeller disc. At this outer end the angle b is set at a value in the range of from about 50 to about 70 degrees, for reasons that will be set forth presently.

Since the impeller portion 50 of each main blade 44 is angled toward the direction of impeller rotation as above stated, the impeller portion has, when seen in a front view as in FIG. 9, an angle c which is determined in accordance with the angle b at the outer end of the impeller portion. Preferably, the angle c of the impeller portion as seen in a front view is about 14 degrees if the angle b at the outer end of the impeller portion is 50 degrees; about 10 degrees if the angle b is 60 degrees; and about 6 degrees if the angle b is 70 degrees.

The inducer portion 52 of each main blade 44 is shown to be identical in shape with the inducer portion 26 of the prior art impeller blade 20 shown in FIG. 1 and is likewise angled forwardly from the impeller portion 50 with respect to the direction of impeller rotation. The angle d of the inducer portion 52 as seen in a front view as in FIG. 9 is about 30 degrees.

Moreover, as will be evident from a comparison of FIGS. 3 and 11, the inducer portion 52 of the improved impeller blade 44 is set at substantially the same angle to the front face 48 of the impeller disc 36 as the inducer portion 26 of the prior art impeller blade 20. Thus, since the impeller portion 50 of the blade 44 is mostly more or less inclined toward the direction of impeller rotation, the aforesaid "transmition angle" a between the impeller and the inducer portions is considerably less than that of the prior art impeller blade 20, resulting in a decrease in pressure loss.

Arranged radially on the impeller disc front face 48 and interposed between the main blades 44, the auxiliary blades 46 are intended to increase the volume of the fluid handled by the compressor and are each shaped and sized like the impeller portion 50 of each main blade 44. Also like the main blade impeller portions 50, each auxiliary blade 46 is set at an angle of about 90 degrees, usually slightly less than 90 degrees, to the impeller disc front face 48 at the inner end of the auxiliary blade. This angle gradually decreases toward the outer end of the auxiliary blade, at which end the angle ranges from about 50 to about 70 degrees.

Figure 13:
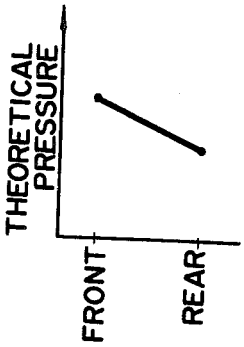
FIG. 13 is a graphical representation of the theoretical fluid pressure distribution at the outlet of the improved impeller of FIGS. 8 and 9 and in the direction parallel to the impeller axis.
Figure 14:
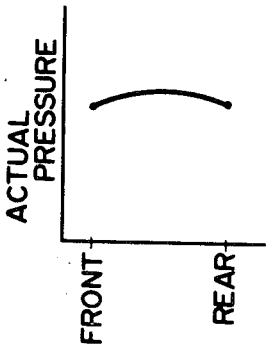
FIG. 14 is a graphical representation of the actual fluid pressure distribution at the outlet of the improved impeller and in the direction parallel to the impeller axis.
Figure 15:
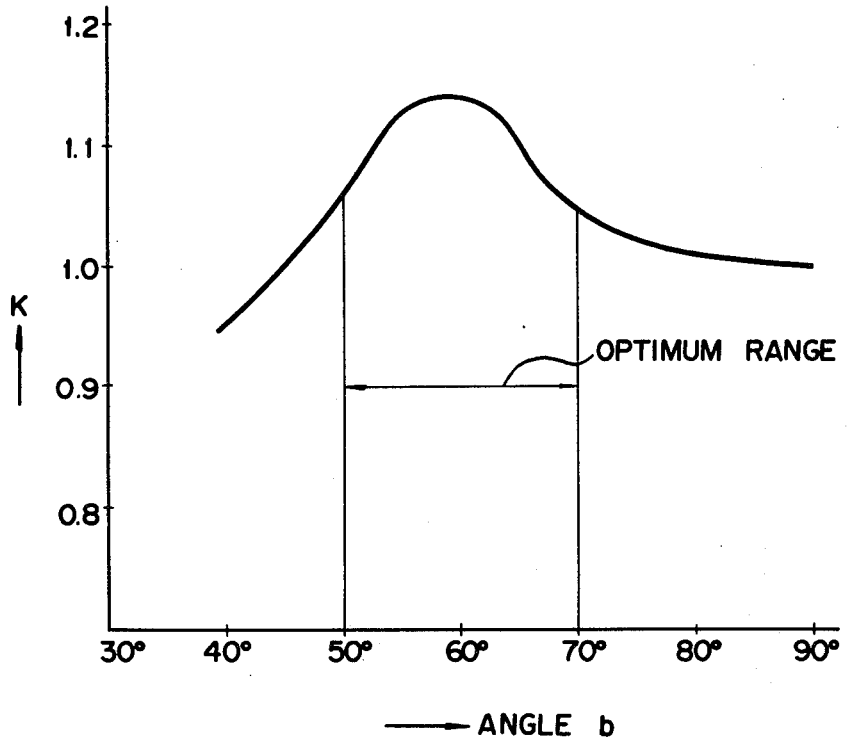
FIG. 15 is a graph explanatory of the relationship between compression efficiency and the angle between the impeller portion of each main blade and the front face of the impeller disc.

The improved impeller 30 of the centrifugal compressor in accordance with this invention being constructed as in the foregoing, the theoretical fluid pressure developed at the impeller outlet 54 becomes higher on its front side than on its rear side, as graphically represented in FIG. 13. Since the pressure loss distribution of the centrifugal compressor in question is as explained above in connection with FIG. 6, the actual fluid pressure at the impeller outlet becomes substantially constant in the direction parallel to the drive shaft 42, as plotted in FIG. 14. The result of this is an increase in the total work done by the compressor, with improvement in its compression ratio and efficiency.

In actually designing the impeller blading of a given centrifugal compressor in accordance with the teachings of this invention, the actual pressure distribution at the impeller outlet of the compressor may first be measured. From this measurement there may be computed the decrease in the fluid pressure on the front side of the impeller outlet.

Generally speaking, the highest compression ratio will result if the angle b between each main blade impeller portion 50 and the impeller disc front face 48 is set in the range of from about 50 to about 70 degrees, preferably about 60 degrees, at the outer end of the blade. This is apparent from the graph of FIG. 15, wherein the K represents the quotient of the compression efficiency when the angle b at the outer end of each blade is arbitrarily determined by the compression efficiency when the angle b is 90 degrees.

It will be evident from the foregoing description that there has been provided an impeller well calculated to improve the performance of a centrifugal compressor. Although the improved impeller of this invention has been shown and described in its specific form, it is understood that the invention itself is not to be restricted by the exact showing of the accompanying drawings or the description thereof. For instance, the purposes of this invention can be attained without necessarily providing the auxiliary blades 46. This and other modifications and variations will readily occur to those skilled in the art without departure from the spirit or scope of the invention as expressed in the following claims.

What is claimed is:

1. An impeller for a centrifugal compressor comprising, in combination, a disc having a hub portion and a plurality of blades fixedly mounted at angularly spaced locations on a front face of the disc, each blade integrally comprising an impeller portion extending substantially radially of the disc and a centrally located inducer portion on the front side of the impeller portion, the angle between the impeller portion of each blade and the front face of the disc being about 90 degrees at the inner end of the impeller portion and gradually decreasing toward the outer end thereof at which the angle therebetween is in the range of from about 50 to 70 degrees, the impeller portion of each blade being thus mostly inclined forwardly with respect to the direction of rotation of the disc, the inducer portion of each blade being further inclined forwardly from the impeller portion with respect to the direction of rotation of the disc.

2. The impeller as recited in claim 1, wherein the angle (c) of the impeller portion of each blade as seen in a front view is in the range of from 6 to about 14 degrees.

3. The impeller as recited in claim 1, wherein the angle (d) of the inducer portion of each blade as seen in a front view is about 30 degrees.

4. The impelleer as recited in claim 1, further comprising a plurality of secondary blades of auxiliary nature fixedly mounted on the front face of the disc in radial arrangement and alternately with the first recited blades.

5. The impeller as recited in claim 4, wherein each secondary blade is shaped and sized substantially like the impeller portion of each first blade, and wherein the angle between each secondary blade and the front face of the disc is about 90 degrees at the inner end of the second blade and gradually decreases toward its outer end at which the angle therebetween is in the range of from about 50 to about 70 degrees.

* * * * *